US011577141B2

(12) United States Patent
Sudit

(10) Patent No.: US 11,577,141 B2
(45) Date of Patent: Feb. 14, 2023

(54) DOWNHILL SKI TRAINING METHOD AND APPARATUS

(71) Applicant: Michael S. Sudit, Minnetonka, MN (US)

(72) Inventor: Michael S. Sudit, Minnetonka, MN (US)

( * ) Notice: Subject to any disclaimer, the term of this patent is extended or adjusted under 35 U.S.C. 154(b) by 176 days.

(21) Appl. No.: 17/061,006

(22) Filed: Oct. 1, 2020

(65) Prior Publication Data

US 2021/0101063 A1 Apr. 8, 2021

Related U.S. Application Data

(60) Provisional application No. 62/910,993, filed on Oct. 4, 2019.

(51) Int. Cl.

| | |
|---|---|
| ***A63B 69/18*** | (2006.01) |
| ***A63B 69/00*** | (2006.01) |
| ***A63B 60/22*** | (2015.01) |
| ***A63C 11/22*** | (2006.01) |

(52) U.S. Cl.

CPC ..... *A63B 69/18* (2013.01); *A63B 69/00* (2013.01); *A63C 11/2228* (2020.08); *A63B 60/22* (2015.10); *A63B 2208/12* (2013.01); *A63B 2214/00* (2020.08); *A63B 2225/09* (2013.01); *A63B 2244/19* (2013.01)

(58) Field of Classification Search

CPC ..... A63C 11/2228; A63C 11/227; A63B 2244/19; A63B 2208/12; A63B 2214/00; A63B 2225/09; A63B 2071/0694; A63B 2210/50; A63B 69/18; A63B 69/00; A63B 60/22

See application file for complete search history.

(56) References Cited

U.S. PATENT DOCUMENTS

| | | | |
|---|---|---|---|
| 4,643,444 | A | 2/1987 | Parkinson |
| 5,378,156 | A | 1/1995 | Rohe |
| 6,592,150 | B2 | 7/2003 | Kernan |

(Continued)

OTHER PUBLICATIONS

"CoPilot Ski Trainer" by Snowcraft. Retrieved from the Internet: <URL: https://www amazon.com/CoPilot-Trainer-Learn-Harness-Teach/dp/B0030MP4C4>.

(Continued)

*Primary Examiner* — Megan Anderson

(74) *Attorney, Agent, or Firm* — Merchant & Gould P.C.

(57) ABSTRACT

An instructional device for an instructor to use with a student for downhill skiing is disclosed. In use, the instructor skis to the side and behind the student skier. A curved extension member is provided at the end of a shaft and is placed against the student skier's midsection to provide stability and balance for the student. Two student handles can be attached to the extension member. The student handles serve two purposes. The device can be easily converted for use either from the student's right side or left side, depending on the instructor's preference. Second, the student handles can be added as the student progresses to help correctly position the student's hands and develop good posture for the eventual use of ski poles. An instructor handle is located along the shaft. The instructor handle may be adjustable along the length of the shaft.

15 Claims, 10 Drawing Sheets

(56) References Cited

U.S. PATENT DOCUMENTS

| | | | | |
|---|---|---|---|---|
| 8,721,343 | B2 * | 5/2014 | Davis | A63C 5/16 280/809 |
| 9,950,233 | B2 * | 4/2018 | Bilbao | A63C 11/10 |
| 2006/0110716 | A1 * | 5/2006 | Micari | A63B 69/18 434/253 |
| 2014/0335492 | A1 * | 11/2014 | Braaten | A63B 69/18 434/253 |
| 2021/0213343 | A1 * | 7/2021 | Gotthelf | A63B 69/0057 |

OTHER PUBLICATIONS

"Launch Pad Ski Trainer Hamess" LevelNineSports.com [online]. Retrieved from the Internet: <URL: https://www.levelninesports.com/launch-pad-ski-trainer-harness/>. Retrieved on Apr. 16, 2019, 5 pages.

"Launch Pad Wedgease Ski Tip Connector" by Launch Pad. Retrieved from the Internet: <URL: https://www.amazon.com/Launch-Pad-Wedgease-Connector-Trainer/dp/B0084G1PNI>. Retrieved on Apr. 16, 2019, 2 pages.

"Slope Ropes Kids Ski Harness." Retrieved from the Internet: <URL: https://www.amazon.com/Slope-Ropes-Trainer-Easiest-Learn/dp/B01M8P9ANM>. Retrieved on Apr. 16, 2019, 2 pages.

"Teach Children to Ski with Hand-Z-Bar." Retrieved from the Internet: <URL: https://images-na.ssl-images-amazon.com/images/l/619-953q5uL.jpg>. Retrieved on Apr. 16, 2019, 2 pages.

* cited by examiner

DOWNHILL SKI TRAINING METHOD AND APPARATUS

CROSS-REFERENCE TO RELATED APPLICATIONS

This application claims the benefit of U.S. Provisional Patent Application No. 62/910,993, filed Oct. 10, 2019, entitled, "A DOWNHILL SKI TRAINING METHOD AND APPARATUS." The disclosure of this priority application is hereby incorporated by reference in its entirety into the present application.

FIELD OF THE INVENTION

This invention relates generally to alpine skiing; and more particularly to a method and apparatus for teaching downhill skiing skills and developing student confidence on snow skis.

BACKGROUND

There are a number of methods and training aids often used to teach students downhill skiing. One of the most common methods used with small children is for the instructor to ski with his or her skis spaced wide apart and then position the child between the instructor's skis (e.g., between the legs of the instructor). Another method has the instructor skiing downhill backwards in front of the student. However, both of these methods have drawbacks in that the student is not learning natural balance and may create risks if the student falls. In addition, in the latter case, the instructor is skiing blindly backwards down the hill. This may lead to unintended collisions with objects, other skiers, moguls, ice, etc.

There are training systems that include reins or straps attached to a student skier via a belt or shoulder harness. Other styles of harnesses are not attached to a skier, but instead include a loop that encircles the student around the midsection or include a short straight bar that is located at the midsection. In the latter case, the student skier can grip the bar near the ends and the reins are attached to the ends. Still other harness training systems are attached to the boots of the student skier.

Each of these rein related systems have drawbacks. More specifically, use of the reins attached to the skier or connecting with the skier's midsection create a tendency for the student to lean forward. Further, the instructor may not be able to see all obstacles in front of the student as the reins place the instructor directly behind the student. In addition, this type of aid does not allow the student's upper body and hands full freedom to find the natural balance, introduce the use of ski poles and/or provide a solid object to grasp while developing confidence in his or her balance.

Therefore, there is a need in the art for a method and apparatus which is capable of teaching downhill skiing skills and developing student confidence on snow skis. The present invention addresses these needs in the art.

SUMMARY

A preferred embodiment of a method and apparatus constructed in accordance with the principles of the present invention includes a device that allows for both the young student and the instructor to have full visibility both downhill and to the sides. In use, the instructor is positioned to the side and behind the student. This provides a positioning between the student and instructor that promotes visibility so that the instructor can see obstacles and promotes safety if the student falls.

The device includes one or more handles for the instructor to grasp. An optional or removable handle may be attached to a shaft at a proximal end. If the handle is not included, then the instructor may grasp the end of the shaft. Preferably there is a handle for the instructor to grasp located between the midsection and proximal end of the shaft. In some embodiments, this handle is adjustable to different positions on the shaft to accommodate different size and height differences between the instructor and student.

Attached to the distal end of the shaft is an extension member. The extension member generally forms an oblique angle with respect to the longitudinal axis of the shaft. The extension member preferably has a rounded shape in order to fit passively around the skier's midsection. The device is constructed of a rigid material to provide proper ergonomics, stability and balance for both the instructor and student.

One advantage of the device is that the instructor is able to control the student's speed by matching and controlling his or her own speed, and then slowing the student by applying pressure through the device against the midsection of the student. Another advantage is due to the instructor being able to selectively place the device against the skier's midsection. This insures that the arms of the student are completely free which assists the student in both learning and gaining balance. Yet another advantage is that use of the device and method provides training and building skills without direct touch or contact (and creating distance between the instructor and student). Still further, another advantage of the device and method is that it can be used with adaptive skiers.

An optional feature of the device is that once proper balance has been achieved by the student, two handles can be attached to the extension member. By grasping the handles, the student may be introduced to the concept of ski poles. The handles may be removable or rotatable (i.e., from an in-use position to a folded out of the way position when not in use). Accordingly, the device provides a teaching and learning aid for downhill alpine skiing, designed for improved safety, security and simplicity.

Therefore, according to one aspect of the invention, there is provided a ski trainer device, comprising a shaft, the shaft including a proximal end, a distal end, and having a longitudinal axis; a grip or handle is cooperatively connected to the proximal end; and an extension member connected to the distal end, the extension member having a mean axis, the mean axis forming an oblique angle with respect to the longitudinal axis of the shaft.

According to another aspect of the invention, there is provided a ski training method for a ski instructor using a training device, the training device including a shaft having a first end and a second end, the shaft further including an instructor handle located between the first end and the second end, and an extension member located at the second end of the shaft and forming an oblique angle relative to the shaft, the method comprising: grasping the first end of the shaft and the instructor handle of the training device; skiing to the side and behind a student skier; extending the training device to engage the midsection of the student skier with the extension member, whereby the speed of the student skier may be controlled by the ski instructor.

According to another aspect of the invention of the previous paragraph, the hands of the student skier may be placed on the extension member or on student handles located on the extension member.

While the invention will be described with respect to preferred embodiment configurations and with respect to particular components and structures, it will be understood that the invention is not to be construed as limited in any manner by either such components and structures described herein. Instead, the principles of this invention extend to any method and apparatus in accordance with the claims.

These and other variations of the invention will become apparent to those skilled in the art upon a more detailed description of the invention. The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

BRIEF DESCRIPTION OF THE DRAWINGS

Referring to the drawings, wherein like numerals represent like parts throughout the several views.

DETAILED DESCRIPTION

Figure 1:
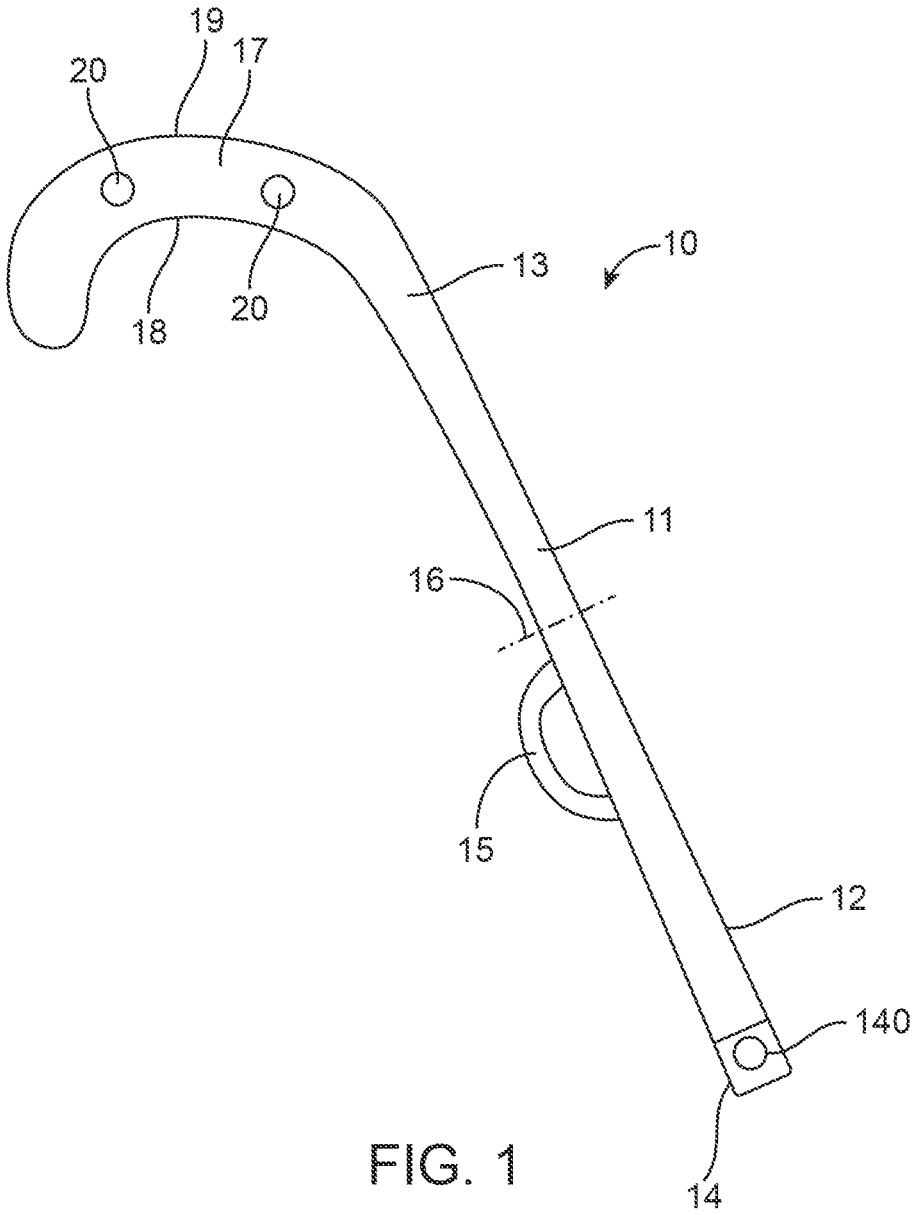
FIG. 1 is a top plan view of an embodiment ski training aid device in accordance with the principles of the invention.

The principles of the present invention apply particularly well to its application as a training aid for downhill (or Alpine) skiing. The instructional device allows for both the student and the instructor to have full visibility both downhill and to the sides. Turning to FIG. 1, with the instructional device 10, the instructor skis to the side and behind the skier (best seen in FIG. 2). The rounded extension member 17 of the device 10 fits passively around the student skier's midsection and provides proper ergonomics, stability and balance for the student as well as the instructor. With this positioning, the arms of the student are completely free—thereby assisting the student in learning and gaining balance.

Once proper balance has been achieved by the student, two easily removed and replaced handles 21 (best seen in FIGS. 4*a* and 4*b*) can be attached to the extension member 17. The detachable handles 21 serve two purposes. First, the device can be easily converted for use either from the student's right side or left side, depending on the instructor's preference. Second, the handles 21 can be added as the student progresses to help correctly position the student's hands and develop good posture for the eventual use of ski poles.

Utilizing the device 10, the instructor has total control of the skier's speed, which gives the student a significant sense of security and assists in gaining balance and positioning of the skis in both wedge (slowing and stopping) and parallel (for increased speed) situations.

As the student progresses further, the device 10 can easily be pulled away from the student while skiing. This creates a situation where they are allowed to ski freely and unencumbered. Alternatively, the device 10 can be readily replaced back around the student midsection should there be a loss of control, another skier or obstacle creates a situation requiring additional control and/or some other situation arises where there is a need to prevent possibility of injury.

Still referring to FIG. 1, a device 10 constructed in accordance with the principles of the present invention will be described in more detail. The device 10 includes a shaft 11 having a proximal end 12 and a distal end 13 (i.e., proximal and distal from an instructor when in use). The device further includes one or more instructor handles 14, 15 for an instructor to grasp.

First, an optional and/or removable handle or grip may be attached to the shaft 11 at the proximal end 12 at void 140. The handle is preferably similar to the handles 21 shown in FIGS. 4*a* and 4*b*. However, it will be appreciated that handles with differing geometries and structures may be provided. If the optional handle is not included or has been removed, then the instructor may grasp the proximal end 12 of the shaft 11. A knob or enlarged section (e.g., similar to the knob on a baseball bat)(not shown) may also be located at the proximal end 12 to help the instructor grip the device 12.

Figure 7A:
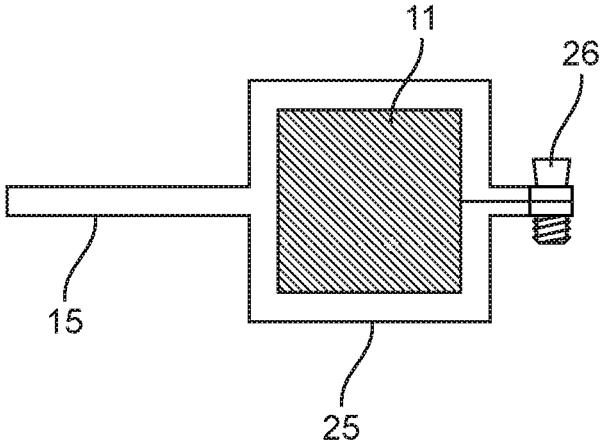
FIGS. 7*a* and 7*b* illustrate an embodiment of fittings which may be used in connection with adjusting the handle on the shaft of the device of FIG. 1.
Figure 7B:
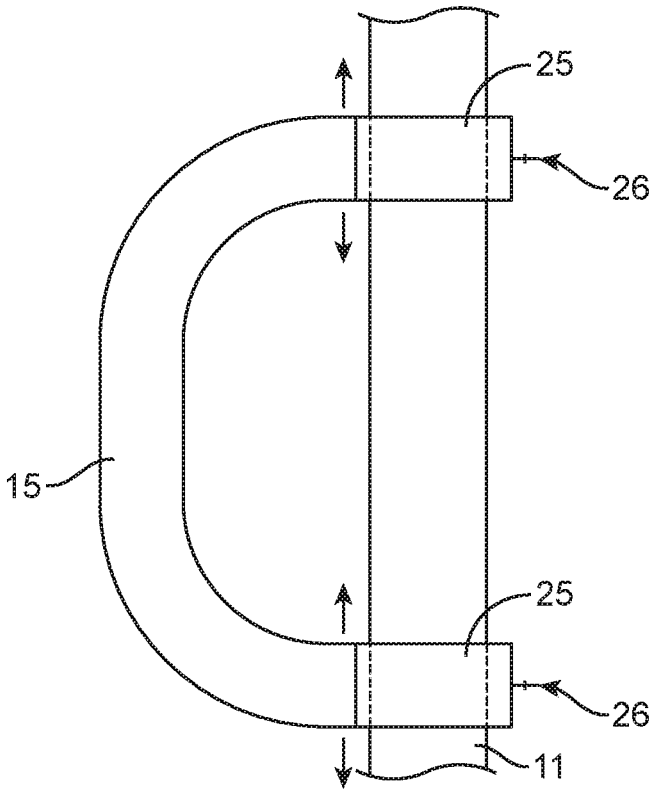

Second handle 15 is for the instructor's use and is mounted on the shaft between the midsection of the shaft 11 (indicated at dotted line 16) and proximal end 12 of the shaft 11. Handle 15 may be integrally formed with the shaft 11, may be secured with a fitting (e.g., as shown in FIGS. 7*a* and 7*b*), or may be affixed thereto (e.g., with glue, screws, tape, etc.). As shown in FIGS. 7*a* and 7*b*, a friction fitting 25 may be used with a securing member 26 that brings the fitting 25 into a tight engagement with the shaft 11. It will be appreciated by those of skill in the art that in this arrangement a fitting 25 is located at each end of the second handle 15. An advantage of this arrangement is that the second handle 15 may then be moved up and down the shaft 11 to accommodate different size and height students—as well as the comfort and preference of the instructor.

Extension member 17 is located at the distal end 13 of shaft 11. Extension member 17 includes an outward facing surface 19 and an inward facing surface 18. The inward facing surface is arranged and configured to be placed on or around the midsection of a student skier. Accordingly, a rounded surface 18 will generally provide a more comfortable surface area to engage the student's midsection and spread the forces (e.g., created when slowing a student skier) over a larger area. However, other inward facing surfaces 18 may also be used. For example, straight, diagonal and two surfaces coming together at an oblique angle might be used for surface 18.

Figure 6:
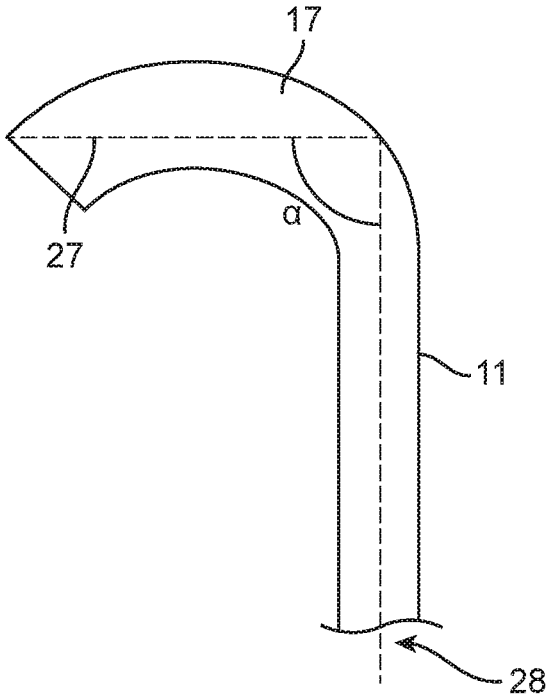
FIG. 6 is a diagrammatic view of the mean longitudinal axes of the shaft 11 and extension member 17 and the angle $\alpha$ formed by the mean axes.

Referring to FIG. 6, a diagrammatic view illustrating the angle α formed by the mean axis 28 of the shaft 11 and the mean axis 27 of the extension member 17 is provided. The mean axis 28 of the shaft is generally formed by the longitudinal axis of the shaft 11. However, the shaft 11 may include curves in some embodiments. The angle α is preferably an oblique angle. However, a right angle may also be used. An acute angle may tend to create a pinch point between the inward facing surface 18 and the midsection of the student. However, the principles of the invention may still be practiced with such an arrangement.

Figure 4A:
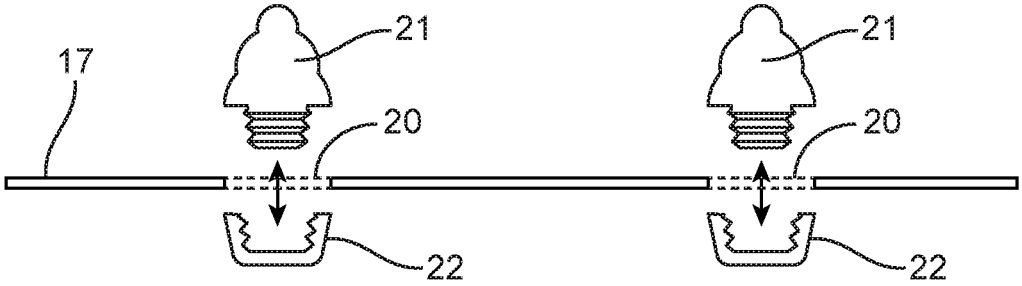
FIG. 4*a* is an illustration of an embodiment of the device of FIG. 1 including detachable handles located on the extension member.
Figure 4B:
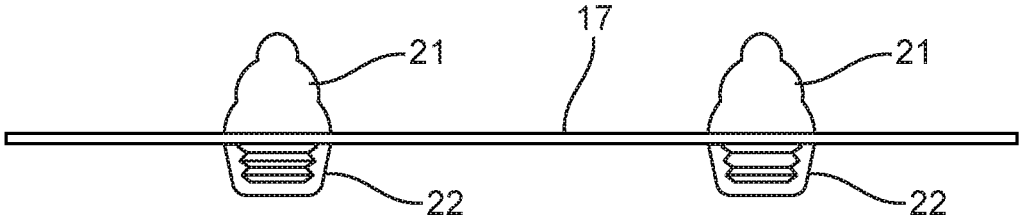
FIG. 4*b* illustrates the detachable handles of FIG. 4*a* with the handles in place.
Figure 5:
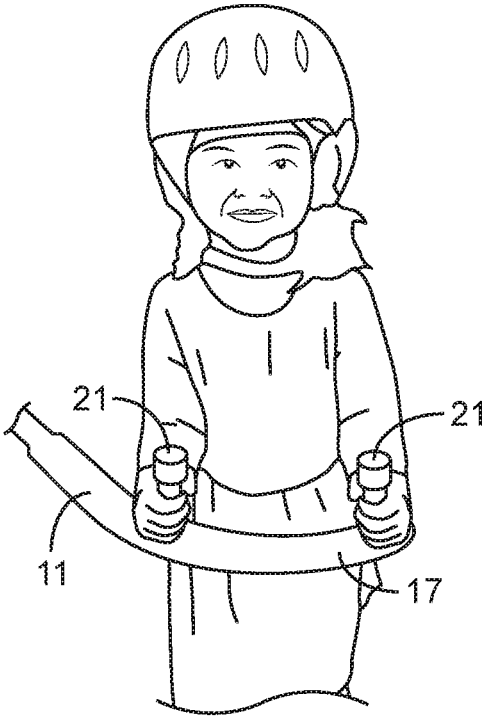
FIG. 5 illustrates the device in use with a student grasping the handles of FIG. 4*b*.

Referring now to FIGS. 1, 4A and 4B, in some embodiments extension member 17 may include voids 20 in which removable student handles 21 may be selectively inserted and affixed. In one embodiment, handles 21 include a screw, channel lock, or keyhole element which extends through extension member 17. Complementary corresponding elements 22 have a suitable thread or other device to secure the handles 21. The handles 21 preferably include a diameter and length that is sized for the student. Accordingly, in some embodiments, different size handles 21 may be utilized depending on the student. FIG. 5 illustrates the handles 21 in place with a child student skier grasping the same.

In a preferred embodiment, the various components of the device 10 are constructed of molded or injectable plastic. However, wood, aluminum, and other materials might be used. A design consideration for some embodiments of device 10 is that it will generally be used in cold weather. Accordingly, wood and plastic may be preferred due to heat transfer and comfort to the instructor. Another design consideration is that the device 10 is preferably constructed of a material that has a strength and rigidity for proper ergonomics, stability and balance for both the instructor and student. Further, preferably all edges, handles, extensions etc. are chamfered or rounded to eliminate sharp edges.

In use, the device 10 may help with at least three major components useful for students to learn when beginning downhill alpine skiing. Learning these three components help the student gain control and essential mastery of their skis. Balance is the critical and necessary first step followed by weight transfer and confidence. The present device 10 provides a device and method to address each component. It is anticipated that students of various physical abilities may be taught using the device 10. Accordingly, while the term "mastery of their skis" is mentioned, it is recognized that for some students, the outcome may be competence, enjoyment, and/or a new experience.

Figure 8:
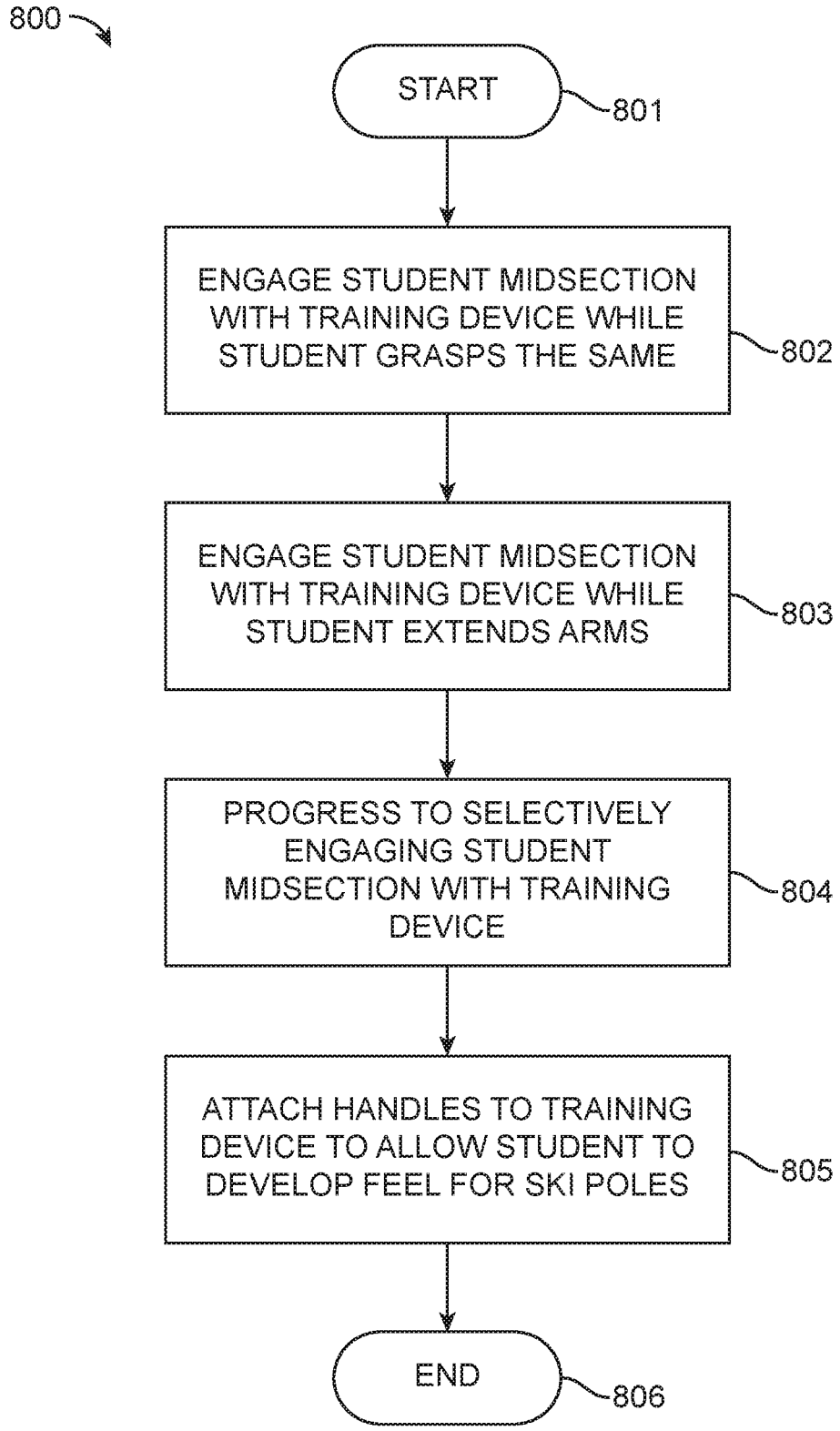
FIG. 8 is a flow chart of the steps taken with the device in use as a teaching aid.

According to some embodiments, a method employing the training device 10 may be used to advance a student through a progression of the three components described in the preceding paragraph. The method is illustrated in FIG. 8 generally at 800 and begins at 801.

Figure 2:
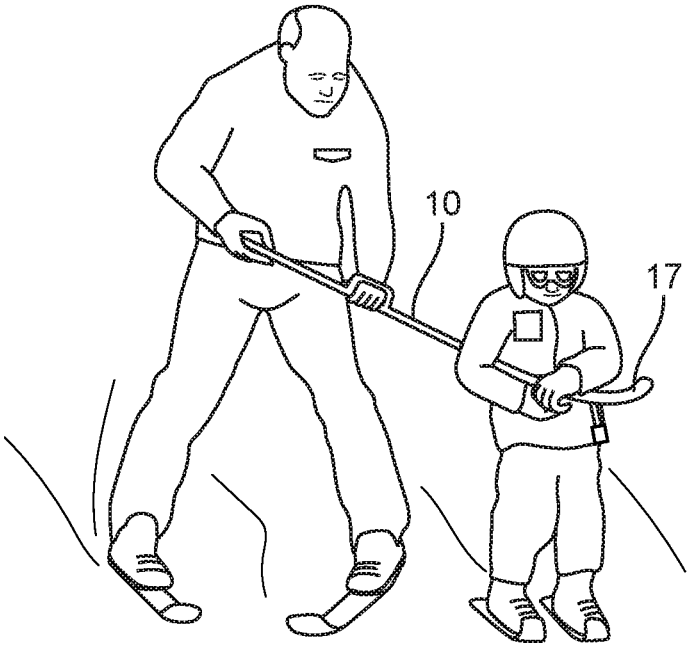
FIG. 2 is an illustration of the device of FIG. 1 in use with the student grasping the device.

Early balance, and then confidence, is achieved by allowing the student to grasp and hold the extension member 17 (as shown in FIG. 2). It allows the student to easily stand while sliding their skis. By doing so, acquiring the necessary balance is facilitated while the student's speed is completely controlled by the instructor. This initial step is reflected at block 802.

Figure 3:
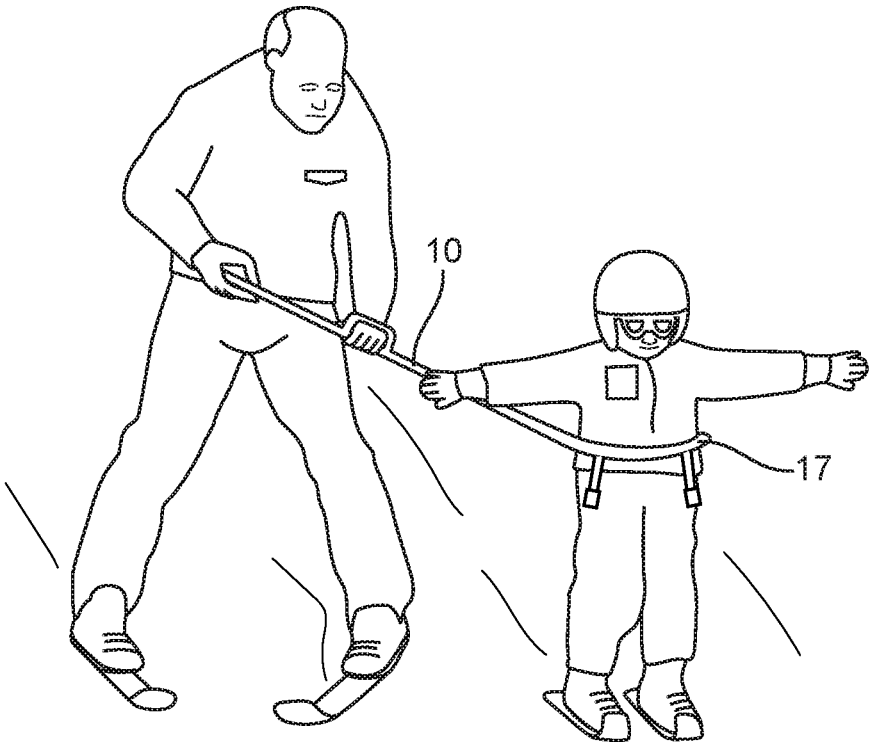
FIG. 3 is an illustration of the device of FIG. 1 in use with the student holding their arms out for balance.

Once early balance (and the fear of falling or going too fast is achieved), the student can begin to utilize their arms by letting go of the extension member 17 and allowing it to passively rest against the midsection (as shown in FIG. 3). At this step, the student advances their sense of balance. This further allows the student to confidently focus and learn proper body and ski positioning—as well as the weight distribution and transfer necessary for the sliding and gliding motion of the skis. All of which is necessary for turning, speed control and stopping techniques. This second step is reflected at block 803.

As skills and confidence are achieved using the device 10, the instructor can selectively employ the device 10 against the midsection of the student and/or control the pressure against the midsection as needed. This step is reflected at block 804.

Further at block 805, as the student continues to gain skills and confidence, the removable handles 21 on the extension member can be added (as shown in FIG. 5), to simulate the proper body and hand positioning for the future utilization of ski poles. This step is reflected at block 805 of FIG. 8. The method ends at 806. It will be appreciated that the method as described herein does not require that the steps recited in FIG. 8 need to be performed in a sequential sequence.

Figure 9:
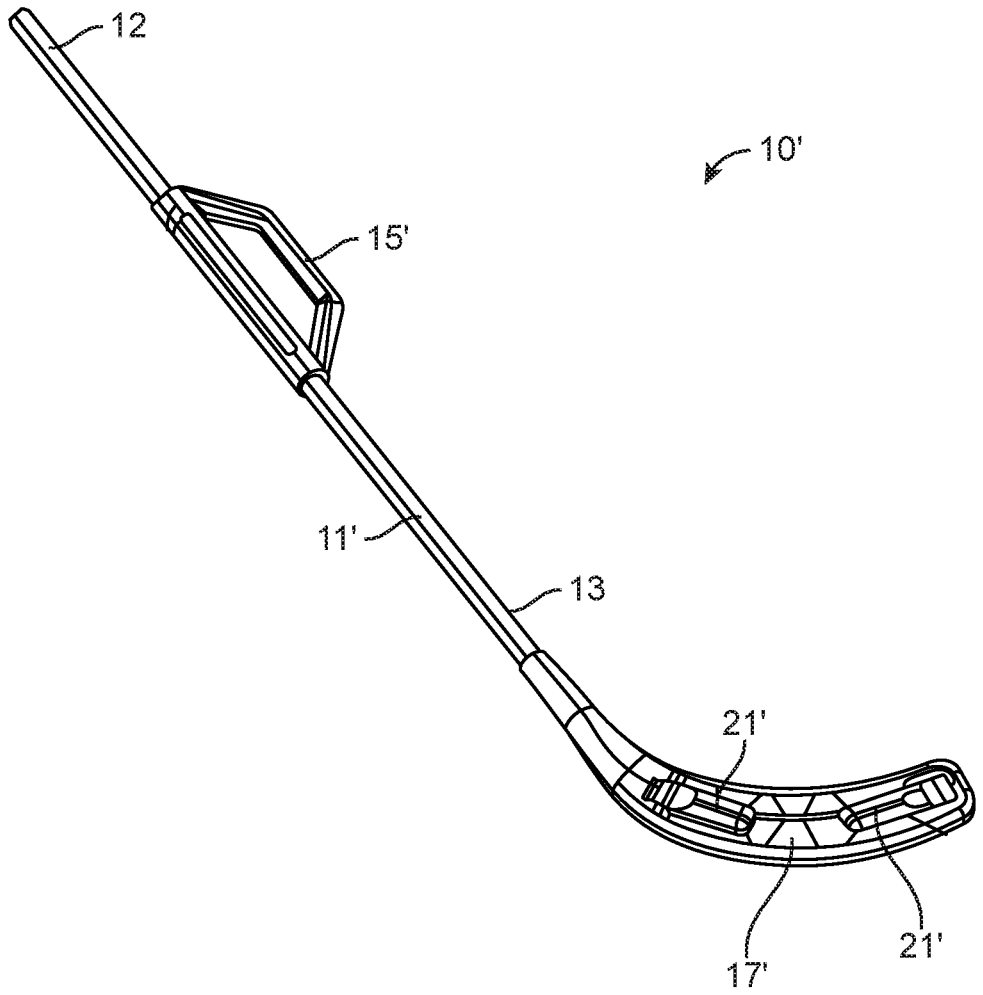
FIG. 9 is an alternative embodiment of the ski training aid device of FIG. 1.

Referring next to FIG. 9, an alternative embodiment of the ski training aid device 10 is illustrated. The alternative embodiment device is illustrated generally at 10'. The device 10' includes an instructor handle 15' between proximal end 12 and distal end 13 of shaft 11'. Extension member 17' is connected at distal end 13. Two foldable handles 21' are cooperatively connected to the extension member 17'.

The shaft 11' may be constructed with aluminum, with the remaining elements of the alternative embodiment device 10' constructed of injected or molded plastic. However, other materials may be used as discussed above in connection with device 10. Also, one design choice which may be advantageous is to select materials and/or material colors such that the device 10' is visible if dropped or left lying on the snow (e.g., a color that is visible when lying on white snow). The alternative embodiment device 10' operates substantially in the manner described above in connection with device 10. However, some structural differences exist, including the rotation of the student handles 21' and the instructor handle 15' connection to shaft 11' as will be described in the following paragraphs.

Figure 10:
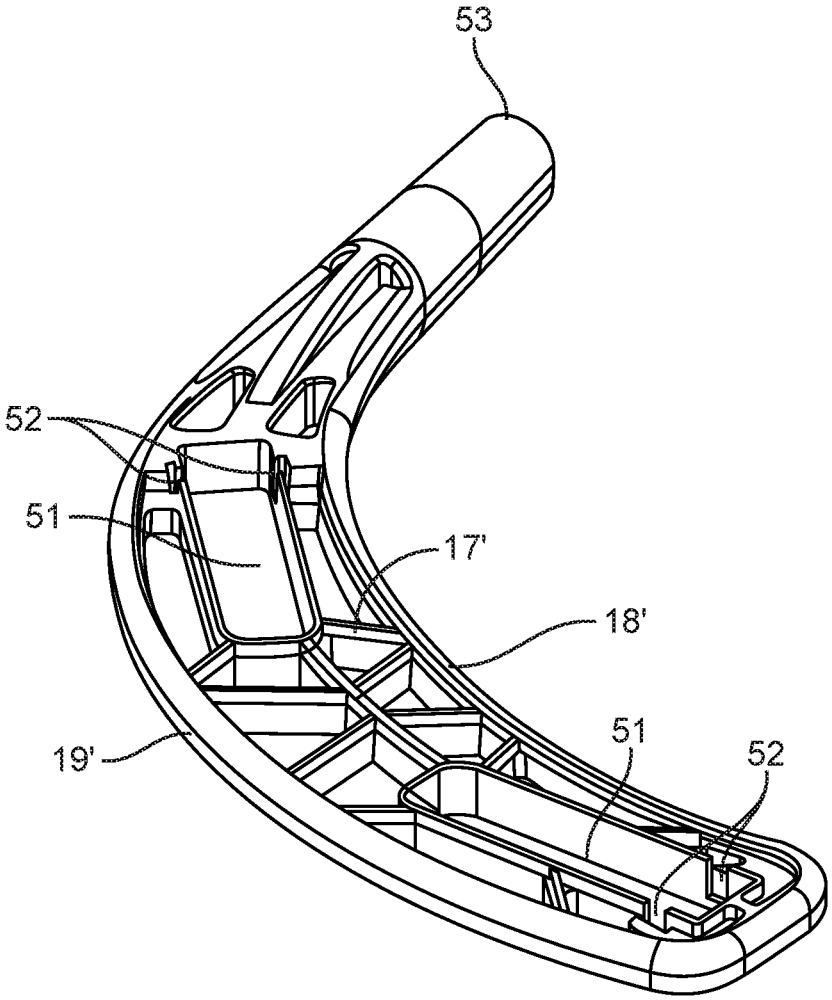
FIG. 10 is a perspective view of the extension member 17' of the ski training aid device 10' of FIG. 9.

Now referring to FIG. 10, a perspective view of the extension member 17' is illustrated. Connector 53 connects with shaft 11'. In the event that the extension member 17' and shaft 11' are not of unitary construction, such connection may be made by adhesive, compression fit, barbed or press fit engagement, and/or screws, among other connection methods. Extension member 17' includes an outward facing surface 19' and an inward facing surface 18'. Voids 51 are formed in the extension member 17' to create spaces into which handles 21' may be rotated when not in use (best seen in FIGS. 9 and 11). Slots 52 are provided within the voids 51 and into which rotational axes of the handles 21' are located.

Figure 11:
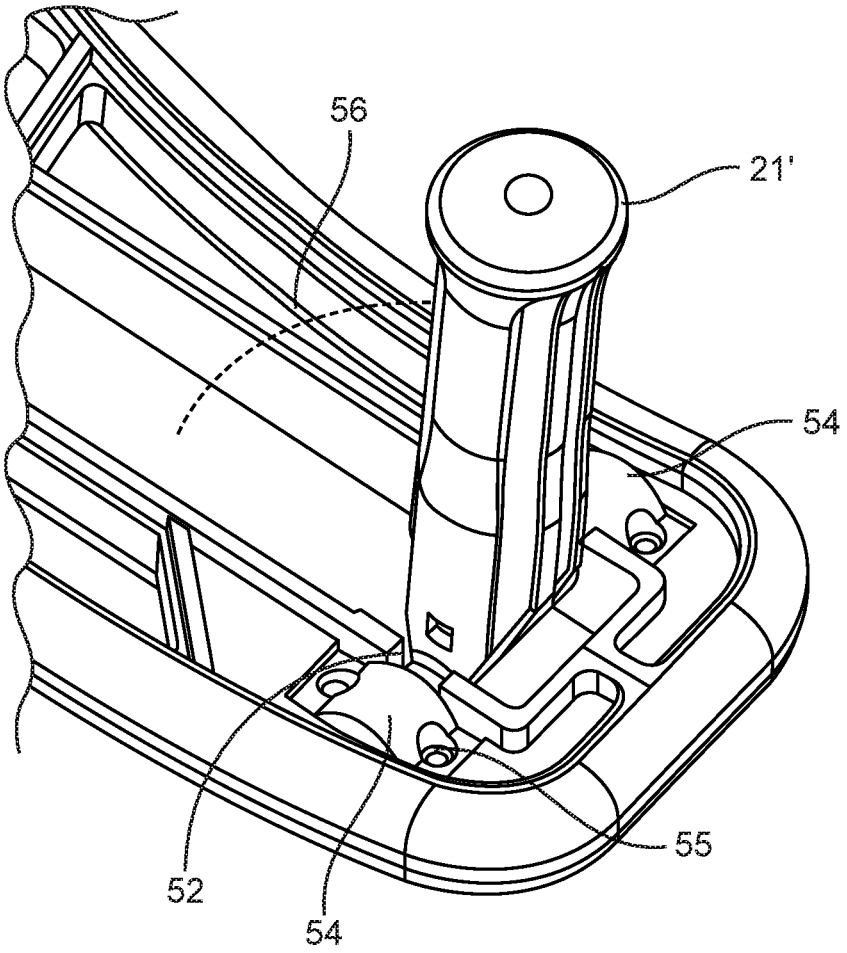
FIG. 11 is an enlarged portion of the perspective view of FIG. 10 illustrating the rotation of the handles 21'.

FIG. 11 illustrates the rotation of handle 21' up out of the mean plane formed by extension member 17' and to within the void 51, the void 51 being located generally within the mean plane formed by extension member 17', along path of rotation 56. Each of the handles 21' may optionally be rotatable into an up out of the mean plane position on either side of the mean plane formed by the extension member 17'. In some embodiments, an axis member is included on either side of handle 21' and extends through the slots 52. The axis member extends into a member such as a friction fit member that can take a circular, some portion of a circle or horseshoe shape (not shown) which is located beneath member cover 54. The member cover 54 engages with a complementary cover on the other face of extension member 17'. The pair of member covers 54 are sized to engage with the member to provide enough friction that the handles 21' remain in the desired position. Alternatively, a detent may be used to maintain the desired position. The bushing cover 54 and its complement are connected with screws 55 or other fastening devices. Optionally, the member may take the form of a bushing or bearing element.

Figure 12:
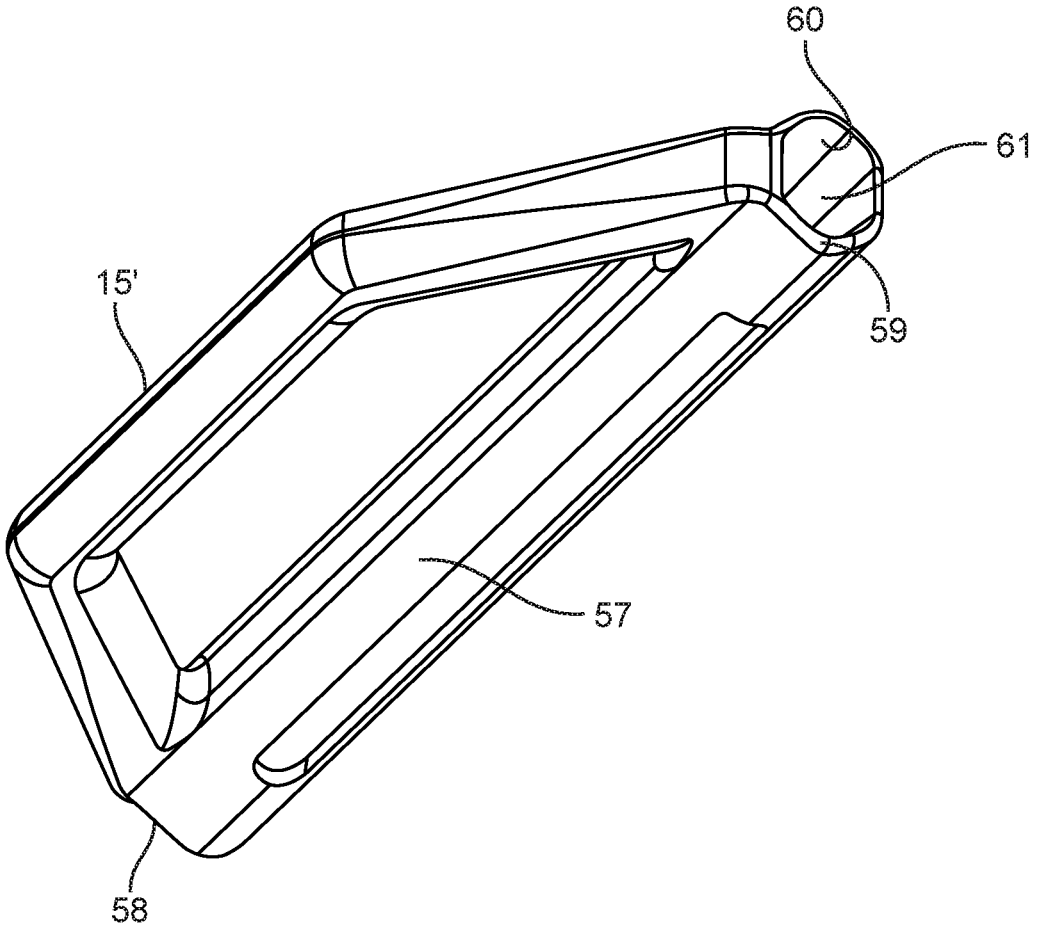
FIG. 12 is a perspective view of the handle 15' of the ski training aid device of FIG. 9.

Turning to FIG. 12, an alternative instructor handle 15' is illustrated. The handle 15' engages with shaft 11'. The handle includes a body 57 having a void 61 through which shaft 11' is inserted. Accordingly, the external portion of shaft 11' engages with the internal surface 60 of body 57. The handle 15' may be affixed to the shaft 11' or may be adjustable. In the case of being affixed, any number of known methods including adhesive, screws, set screws, etc. may be used. In the case of being adjustable, set screws, detents, significant friction engagement and other methods may be employed.

In view of the foregoing, it will be appreciated that the principles of this invention apply to a method and apparatus for downhill ski training. While particular embodiments of the invention have been described with respect to its application, it will be understood by those skilled in the art that the invention is not limited by such application or embodiment or the particular components disclosed and described herein. Further while the description refers to the device 10 being placed against the student's midsection, it will be appreciated that such description is approximate and that the device in practice may actually be placed above (ribs) or below (pelvis) the midsection of the student without departing from the principles of the present invention.

Accordingly, other components that embody the principles of this invention can be configured within the spirit and intent of this invention. The arrangement described herein is provided as only one example of an embodiment that incorporates and practices the principles of this invention. Other modifications and alterations are well within the knowledge of those skilled in the art and are to be included within the broad scope of the appended claims.

What is claimed is:

1. A ski trainer device, comprising:

a) a single shaft, the shaft including a proximal end, a distal end, a midsection and having a longitudinal axis;

b) a grip cooperatively connected to the proximal end of the shaft; and c) an extension member, the extension member having a connected end and a free end, the extension member being connected to the distal end of the shaft solely at the connected end, the extension member having a mean axis, the mean axis of the extension member forming an angle $\alpha$ with the longitudinal axis of the shaft, wherein the angle $\alpha$ is an oblique angle.

2. The ski trainer device of claim 1, further comprising an instructor handle cooperatively connected to the shaft between the proximal and distal end of the shaft.

3. The ski trainer device of claim 2, wherein the instructor handle is adjustable along the longitudinal axis of the shaft.

4. The ski trainer device of claim 1, wherein the ski trainer device is constructed of a rigid plastic.

5. The ski trainer device of claim 1, wherein the angle $\alpha$ is between 90 and 150 degrees.

6. The ski trainer device of claim 1, wherein the extension member has a curved inwardly facing surface, whereby the curved inwardly facing surface is arranged and configured to be placed against a body of a student skier.

7. The ski trainer device of claim 1, further comprising a left and right removable student handle that are each secured, when in use, in corresponding voids in the extension member.

8. The ski trainer of claim 1, further comprising left and right student handles rotatable between first and second positions, wherein in the first position the student handles extend up out of a mean plane formed by the extension member when in use and in the second position lie within the mean plane of the extension member when not in use.

9. A ski training method for a ski instructor using a training device, the training device including a shaft having a first end and a second end, the shaft further including an instructor handle located between the first end and the second end, and an extension member located at the second end of the shaft and forming an oblique angle relative to the shaft, the method comprising:

a) grasping the first end of the shaft and the instructor handle of the training device;

b) skiing to a side and behind a student skier; and c) extending the training device to engage a midsection of the student skier with the extension device, whereby a speed of the student skier is capable of being controlled by the ski instructor.

10. The method of claim 9, further comprising student handles on the extension member, wherein the student handles provide the student skier with a feeling of ski poles.

11. The method of claim 10, wherein the student handles are threadably connected to the extension member.

12. The method of claim 10, wherein the student handles are rotatable from a first position up out of a mean plane formed by the extension device when in use to a second position located in the mean plane of the extension device when not in use.

13. The method of claim 9, wherein hands of the student skier are placed on the extension member, whereby the student skier gains additional balance skills and confidence.

14. The method of claim 9, further comprising adjusting the instructor handle along the shaft to accommodate students of different heights and weights.

15. A ski trainer device, of the type used in connection with a student skier, comprising:

a) a shaft, the shaft including a proximal end, a distal end, a midsection and having a longitudinal axis, the shaft being positioned on a single side of the student skier;

b) a grip cooperatively connected to the proximal end of the shaft; and c) an extension member, the extension member having a connected end and a free end, the extension member being connected to the distal end of the shaft solely at the connected end, the extension member having a mean axis, the mean axis of the extension member forming an angle $\alpha$ with the longitudinal axis of the shaft, wherein the angle $\alpha$ is selected from the group consisting of an oblique angle, a right angle and an acute angle.

* * * * *